US005954445A

United States Patent [19]

Deutschmann et al.

[11] Patent Number: 5,954,445

[45] Date of Patent: Sep. 21, 1999

[54] DIRECTLY MACHINE PRINTABLE INDEX SHEET

[75] Inventors: Christopher Frank Deutschmann, Palatine; David E. Herbst, Bartlett; Dean R. Kasal, Orland Park; Paul Tsu-Peng King, Chicago, all of Ill.

[73] Assignee: ACCO Brands, Inc., Lincolnshire, Ill.

[21] Appl. No.: 08/612,138

[22] Filed: Mar. 7, 1996

[51] Int. Cl.[6] ..... B42F 13/00

[52] U.S. Cl. ..... 402/79

[58] Field of Search ..... 283/36–42, 62; 402/79; 281/38; 226/91–92; D19/1, 2, 33

[56] References Cited

U.S. PATENT DOCUMENTS

| | | | |
|---|---|---|---|
| Re. 5,144 | 11/1872 | Partridge . | |
| 529,477 | 11/1894 | Brown . | |
| 561,888 | 6/1896 | Hon | 283/38 |
| 612,078 | 10/1898 | Wickham . | |
| 764,701 | 7/1904 | Ayres . | |
| 1,048,577 | 12/1912 | Pardoe, Jr. . | |
| 1,142,644 | 6/1915 | Vesterling . | |
| 1,151,475 | 8/1915 | Kingsley et al. . | |
| 1,428,102 | 9/1922 | Kelly | 402/79 |
| 1,501,234 | 7/1924 | Rand . | |
| 1,559,129 | 10/1925 | Pimm . | |
| 1,924,755 | 8/1933 | Rubin . | |
| 2,001,651 | 5/1935 | Bingham | 129/24 |
| 2,300,623 | 11/1942 | Hornong | 283/38 |
| 2,502,785 | 4/1950 | Gottschalk . | |
| 2,576,272 | 11/1951 | Adelman | 40/102 |
| 3,454,451 | 7/1969 | Buckholz | 156/513 |
| 3,970,397 | 7/1976 | Armstrong | 402/79 |
| 4,127,690 | 11/1978 | Schleifenbaum et al. . | |
| 4,184,699 | 1/1980 | Lowe, Jr. | 281/41 |
| 4,240,848 | 12/1980 | Barber | 156/64 |
| 4,422,672 | 12/1983 | Levi . | |
| 4,430,015 | 2/1984 | Nerlinger . | |
| 4,431,325 | 2/1984 | Colby . | |
| 4,447,481 | 5/1984 | Holmberg et al. . | |
| 4,479,733 | 10/1984 | Segal | jf124c |
| 4,523,775 | 6/1985 | Reist | 283/36 |
| 4,560,600 | 12/1985 | Yellin et al. | 428/43 |
| 4,636,179 | 1/1987 | Gentile et al. . | |
| 4,643,455 | 2/1987 | North et al. . | |
| 4,662,770 | 5/1987 | Block | 402/80 R |
| 4,748,758 | 6/1988 | Gaston | 40/359 |

(List continued on next page.)

FOREIGN PATENT DOCUMENTS

| | | |
|---|---|---|
| 2-92696 | 4/1990 | Japan . |
| 23716 | 10/1897 | United Kingdom . |

OTHER PUBLICATIONS

ACCO USA, Inc., Wheeling, Illinois, *Perma Day–Timer* and Fact Book, pp. 29–34, © 1995.

ACCO USA, Inc., Wheeling, Illinois, *Multidex Index* Product Brochure—Quick Reference Index System, © 1992.

Duralon, Product Brochure —excerpt.

JBC Design Group, Inc. Torrance, California, *Extend–A–Tab*™ Product Brochure—Dual–Insertable Tabs, © 1995.

*Primary Examiner*—Willmon Fridie, Jr.

*Attorney, Agent, or Firm*—Pennie & Edmonds LLP

[57] ABSTRACT

An index sheet or divider which may be accommodated by and directly printed upon by a conventional printer. The index sheet is provided with a combination of features selected from one or more perforations or foldable portions defining a guide, foldable bindable portions, hinged cutouts, removable index tab portions and the like which allow the index sheet to pass, in a guided or controlled fashion, through a printer. After the index sheet is directly printed upon, such features also allow the index sheet to be transformed, either manually or by machine, so that an index tab portion of the index sheet stands out, identifies, separates, or otherwise distinguishes documents or items with which one or more index sheets are kept.

14 Claims, 8 Drawing Sheets

U.S. PATENT DOCUMENTS

| | | | |
|---|---|---|---|
| 4,773,676 | 9/1988 | Showering . | |
| 4,779,897 | 10/1988 | Schall et al. . | |
| 4,784,508 | 11/1988 | Shannon | 402/79 |
| 4,802,692 | 2/1989 | Stryd . | |
| 4,803,795 | 2/1989 | Questel et al. . | |
| 4,810,544 | 3/1989 | Hickman | 428/40 |
| 4,844,508 | 7/1989 | Choi | 281/15.1 |
| 4,884,826 | 12/1989 | Slagsvol . | |
| 4,884,827 | 12/1989 | Kelley | 283/81 |
| 4,887,925 | 12/1989 | Groswith, III et al. . | |
| 4,910,066 | 3/1990 | Foisie . | |
| 4,911,777 | 3/1990 | Truc et al. . | |
| 4,952,091 | 8/1990 | Sirko | 402/79 |
| 4,961,666 | 10/1990 | Pitts et al. . | |
| 4,962,603 | 10/1990 | Kao et al. | 40/641 |
| 4,972,952 | 11/1990 | Reisender | 402/79 |
| 4,990,018 | 2/1991 | Best et al. . | |
| 5,016,370 | 5/1991 | Rhian et al. . | |
| 5,040,216 | 8/1991 | Policht | 281/46 |
| 5,044,807 | 9/1991 | Meservy et al. | 402/80 L |
| 5,076,490 | 12/1991 | Dulin | 229/92.8 |
| 5,125,561 | 6/1992 | Idstein | 229/1.5 R |
| 5,135,261 | 8/1992 | Cusack et al. | 285/81 |
| 5,174,606 | 12/1992 | Hure | 281/45 |
| 5,180,461 | 1/1993 | Widmann . | |
| 5,219,183 | 6/1993 | McKillip | 283/62 |
| 5,228,388 | 7/1993 | Brown | 101/226 |
| 5,299,879 | 4/1994 | Burrow . | |
| 5,316,344 | 5/1994 | Popat et al. | 283/81 |
| 5,333,908 | 8/1994 | Dorney et al. | 283/38 |
| 5,340,427 | 8/1994 | Cusack et al. | 156/268 |
| 5,389,414 | 2/1995 | Popat | 428/40 |
| 5,407,234 | 4/1995 | Rettker et al. | 283/62 |
| 5,407,718 | 4/1995 | Popat et al. | 428/42 |
| 5,447,336 | 9/1995 | Deighton | 283/115 |
| 5,468,085 | 11/1995 | Kline | 402/79 |
| 5,503,435 | 4/1996 | Kline | 283/67 |
| 5,524,998 | 6/1996 | Schwartz | 402/79 |
| 5,558,454 | 9/1996 | Owen . | |
| 5,599,128 | 2/1997 | Steiner . | |
| 5,743,566 | 4/1998 | Hunter et al. . | |

DIRECTLY MACHINE PRINTABLE INDEX SHEET

FIELD OF THE INVENTION

The present invention relates generally to index sheets and, more particularly, to bindable index sheets which are directly printable upon, using machines, such as computer operated printers.

BACKGROUND ART OF THE INVENTION

Index tabs for quick identification and selection of information from looseleaf or hardbound binders are a common feature of nearly every well-organized office. Typically, these tabs are provided as markings on certain sheets or pages of binders, books, notebooks, or other sheet material. In order to facilitate scanning and selection of pages, the index tabs are typically staggered or spaced, along two orthogonal planes. For example, the tab mounted on the side of a subsequent index sheet is positioned just far enough below the tab mounted on the side of the immediately preceding index sheet that the identifying text or characters or symbols appearing on both tabs can be seen when the binder is closed and viewed from the adjacent side. Uses for such index tabs range from simple referencing to presentations.

In general, indexing tabs are made in one of two ways. The tabs may be integrally formed as protrusions of the sheets themselves as shown, for example, in U.S. Pat. No. 4,184,699 issued to Lowe on Jan. 22, 1980. Alternatively, the tabs may comprise separate elements which are connected to the index sheets as shown, for example in U.S. Pat. No. 4,962,603 issued to Kao et al. on Oct. 16, 1990; U.S. Pat. No. 5,135,261 issued to Cusack et al. on Aug. 4, 1992; U.S. Pat. No. 5,340,427 issued to Cusack et al. on Aug. 23, 1994; and U.S. Pat. No. 5,389,414 issued to Popat on Feb. 14, 1995.

As Kao et al. indicates, forming index tabs as integral protrusions of the index sheet has been disadvantageous, since it has been difficult to machine print identifying text on the tabs. For example, it has been impractical to insert the entire index sheet into a typewriter in order to type text onto the protruding tab. It has also been difficult or impossible to feed index sheets directly through common office printers, such as laser or inkjet printers, without encountering jamming, feed size limit, or uneven printing problems.

It is desirable to print index sheets on laser or inkjet printers due to the great flexibility of what can be printed as well as the high print quality provided by such printers or the like. However, such printers require the sheet stock to be uniformly dimensioned, at least widthwise, according to standard sizes in order to be accommodated by the standard sized feeding tray or platform of such printers. Otherwise, the sheet stock will either tend to jam such printers or not even fit into such printers. Index sheets, having protruding tabs on the top or leading side first drawn into the printer, can also jam or stray from the correct feed path. Moreover, the sheet stock must be strong enough to withstand the stresses imposed on the sheets by the feeding mechanisms and pressure rollers, and must provide a uniformly smooth surface that will properly take up the toner. Because of these requirements, conventional index sheets having nonuniform widths due to protruding index tabs have been poorly suited for use in laser or inkjet printers.

This drawback is all the more pronounced when the tabs are to be used to mark the pages of a hardbound or softbound book. As a result, the identifying text is usually either handwritten onto the tabs, or else the text is printed on separate adhesive labels which are then placed on the corresponding tabs.

The present invention is directed to overcoming one or more of the problems as set forth above.

SUMMARY OF THE INVENTION

In one aspect of the present invention, a directly machine printable index sheet is disclosed. The index sheet comprises a main body portion having opposed top and bottom sides and opposed first and second lateral sides. The index sheet further includes a base, selected from one of the sides, and an index tab portion integrally formed with the main body portion and which extends from the base. The index sheet further includes a guide connected to the main body portion. The guide has an edge extending beyond the base and which is positioned at a uniform distance from a respective side opposed to the base.

In another aspect of the present invention, there is disclosed a method of directly printing upon an index sheet using a printing machine having a maximum feed width. The method comprises the steps of forming the index sheet according to a first configuration wherein a distance between an index tab portion and an opposed side of the index sheet is less than or equal to the maximum feed width. The method further comprises the steps of feeding the index sheet to the printing machine and printing directly upon the index sheet. The method further comprises the step of transforming the index sheet according to a second configuration in which the distance between the index tab portion and the opposed side is greater than the maximum feed width.

The index sheet of the present invention is provided with a combination of features selected from one or more perforated edges, foldable members, initially closed hinged cutouts, tabs, projections and the like which allow the index sheet to pass, in a guided or controlled fashion, through a printing machine such as a computer printer. After the index sheet is directly printed upon, such features also allow the index sheet to be manipulated, either manually or by machine, so that at least some portion of the index sheet stands out, identifies, separates, or otherwise distinguishes documents or items with which one or more index sheets are kept.

DETAILED DESCRIPTION OF THE INVENTION

Figure 1:
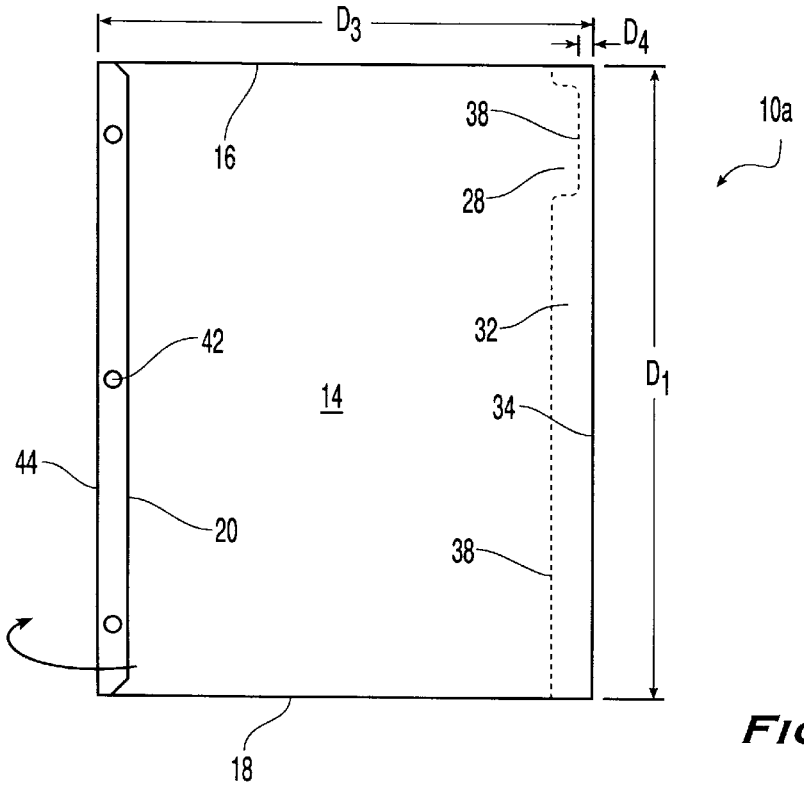
FIG. 1 is a diagrammatic top plan view of a first embodiment of an index sheet of the present invention.

Referring to FIGS. 1–19, wherein similar reference characters designate similar elements or features throughout the Figs., there is shown several embodiments of a bindable index sheet or device 10*a*–101 of the present invention.

In the various embodiments of the index sheet shown in FIGS. 2, 3, 6, 8, 10 and 12–17, the index sheet comprises a generally rectangular main body portion 14 having opposed top and bottom edges 16,18 and opposed first and second lateral edges 20,22. The index sheet further includes a base selected from one of the edges 16,18,20,22 and at least one index tab portion 28. For example, in the various embodiments of the index sheet shown in FIGS. 1–11, the base is selected to be the second lateral edge 22 of the main body portion 14 while in the various embodiments of the index sheet shown in FIGS. 12–14, the base is selected to be the top edge 16 of the main body portion 14. The index tab portion 28 is integrally formed with the main body portion 14 and extends outwardly from the base. The index sheet may be formed, for example, of a substantially pure paper based medium or a composite material such as a paper/plastic laminate.

The index sheet further includes a guide 32 connected to the main body portion 14. In the embodiments of the index sheet shown in FIGS. 1–9, 12, and 14, the guide 32 is removably connected to the main body portion 14. Preferably, the guide 32 is removably connected to both the main body portion 14 and the index tab portion 28. The guide 32 has an outer edge 34 spaced or extending beyond the base and which is positioned at a substantially uniform distance from a respective side opposed to the base. Preferably, as shown in FIG. 1, a line of perforations 38 form a tearable border between the guide 32 and the main body portion 14 as well as between the guide 32 and the index tab portion 28. The perforations 38 are preferably micro perforations formed by die cutting the sheet stock which is formed into an index sheet.

Figure 10:
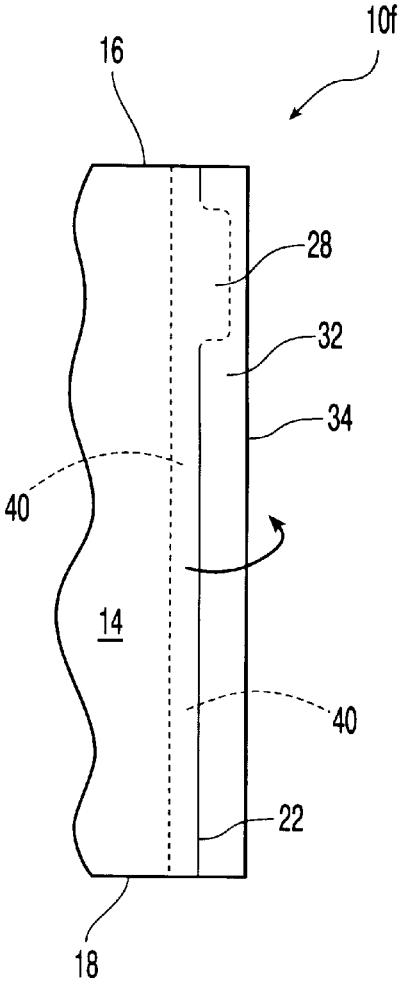
FIG. 10 is a diagrammatic partial top plan view of a sixth embodiment of an index sheet of the present invention.
Figure 11:
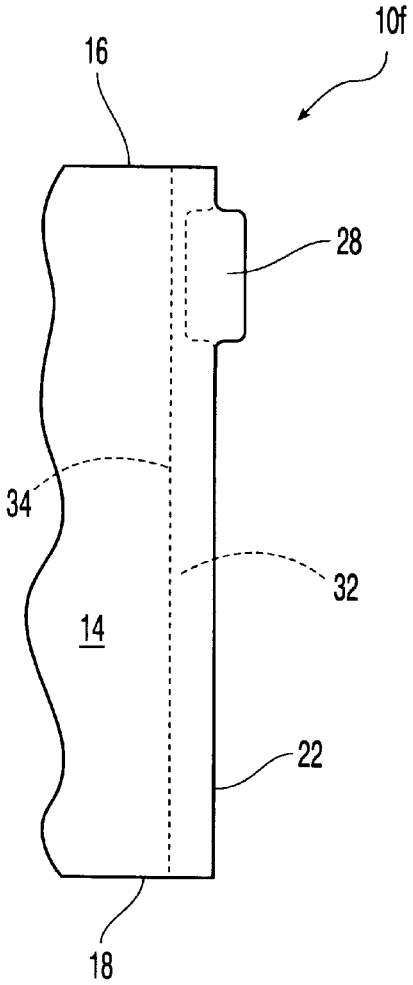
FIG. 11 is a view similar to FIG. 10 but after the index sheet has been transformed.
Figure 12:
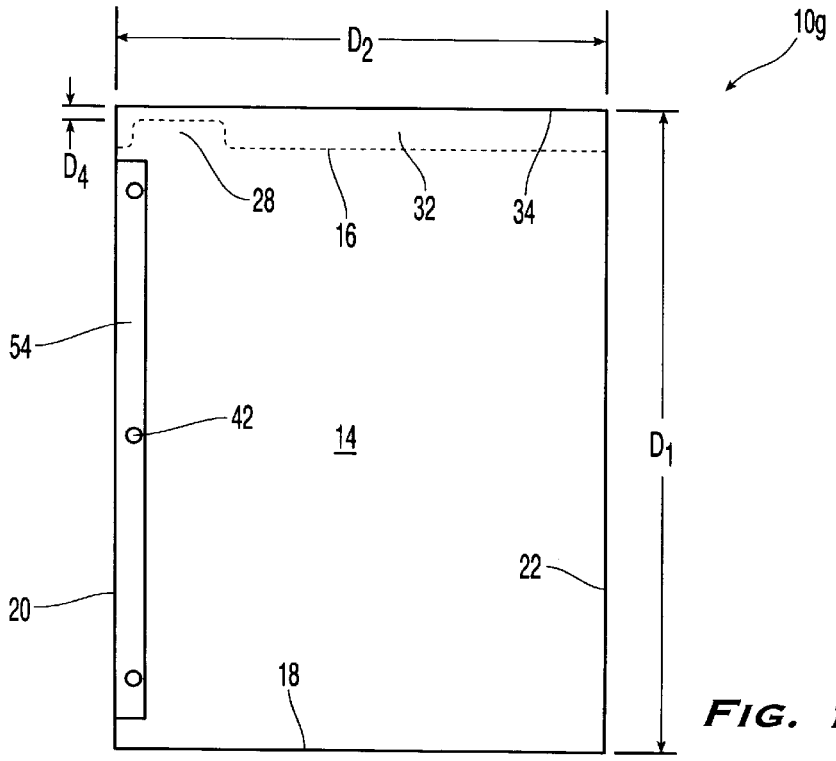
FIG. 12 is a diagrammatic top plan view of a seventh embodiment of an index sheet of the present invention.
Figure 13:
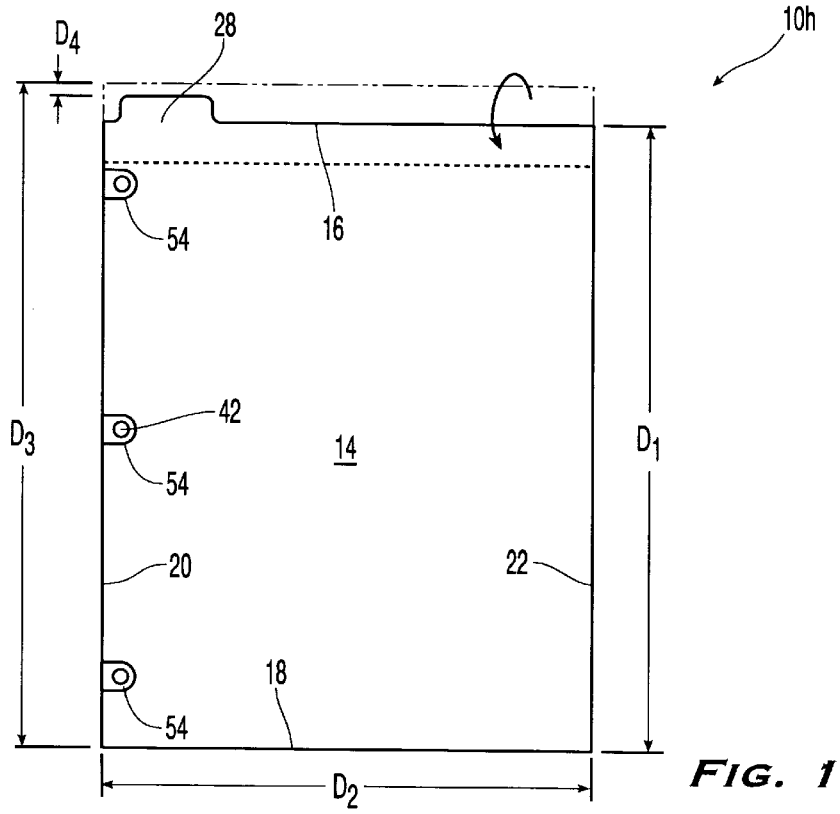
FIG. 13 is a diagrammatic top plan view of an eighth embodiment of an index sheet of the present invention.

In the embodiments of the index sheet shown in FIGS. 10–11 and 13, the guide 32 is inwardly foldable onto the main body portion 14 along a crease line separating the guide 32 from the main body portion 14 and the index tab portion 28.

In the Figs., the dimension $D_1$ represents a distance or length of the index sheet measured between the top edge 16 and the bottom edge 18. The dimension $D_2$ represents a distance or width of the index sheet measured between the opposed lateral edges 20, 22. In FIG. 1 dimension $D_3$ represents a distance or width of the index sheet between the edge 34 of the guide 32 and a crease line 44. In FIG. 13, the dimension $D_3$ represents distance or length of the index sheet between the edge 34 of the guide 32 and the bottom edge 18.

Preferably, the edge 34 of the guide 32 extends or is spaced beyond the index tab portion 28 according to a selected distance $D_4$. The distance $D_4$ functions as a margin to ensure that the index tab portion 28 lies substantially within the printable zone, and conversely, lies substantially away from the unprintable zone typically associated with machine printers. Thus, substantially the entire surface of the index tab portion 28, in addition to the main body portion 14, is available to be printed upon by the machine printer. For example, the distance $D_4$ can be chosen to be about 0.25 inches.

As previously mentioned, the various embodiments of the index sheet shown in FIGS. 10–11 and 13, the guide 32 is foldable along a crease line to reinforce the base. In the embodiment of FIGS. 10–11, the crease line includes the second lateral edge 22. In the embodiment of FIG. 13, the crease line includes the top edge 16. Preferably, an adhesive surface 40 is provided on at least one of the guide 32 and that part of the main body portion 14 adjacent to or near the base. The adhesive surface connects the guide 32 and part of the adjacent main body portion 14 when the guide 32 is folded inwardly along the crease line. This arrangement advantageously reinforces the base of the index sheet to provide more durability and rigidity to that region.

As previously mentioned, in various embodiments of the index sheet shown in FIGS. 1–11, the base is selected to be the second or righthand lateral edge 22. The main body portion 14 adjacent to or near the first or lefthand lateral edge 20 preferably defines at least one bindable hole 42 and a longitudinally extending crease line 44 positioned substantially parallel to the edge 34 of the guide 32. The main body portion 14 adjacent to or near the first lateral edge 20 is foldable along the crease line 44 as shown in FIGS. 2, 3–5, 7 and 9.

In the various embodiments of the index sheet shown in FIGS. 1–2 and 6–17, the first lateral edge 20 is integrally formed on the main body portion 14.

Figure 3:
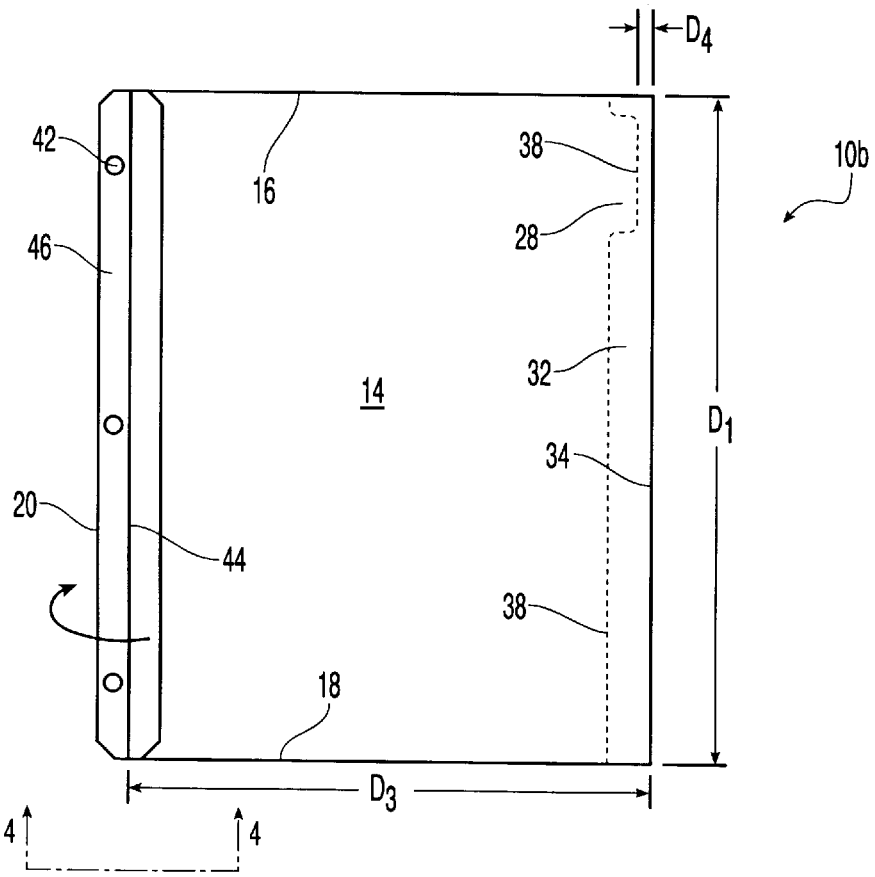
FIG. 3 is a diagrammatic top plan view of a second embodiment of an index sheet of the present invention.
Figure 4:
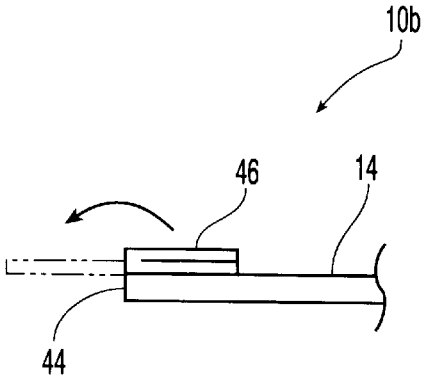
FIG. 4 is an enlarged exaggerated partial end view taken along line 4—4 of FIG. 3, except that a main body portion of the index sheet adjacent to a first lateral side is folded.
Figure 5:
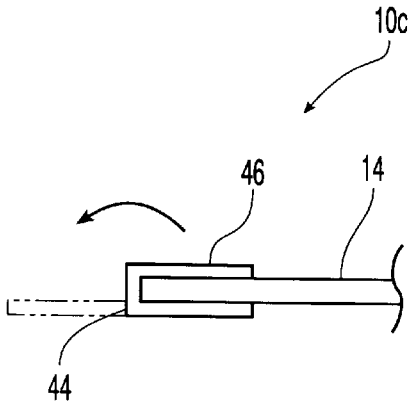
FIG. 5 is a view similar to FIG. 4 but showing a third embodiment of an index sheet of the present invention.

In the embodiment of the index sheet shown in FIGS. 3–5, the first lateral edge 20 is part of a foldable separate member 46 connected to the main body portion 14. Preferably, the separate member is formed of a reinforcing material selected from mylar or the like. A portion of the separate member is bonded to the main body portion on either planar side of the index sheet as shown in FIG. 4 or FIG. 5.

Preferably, the mylar is constructed so that the edge portion which is applied or connected to the index sheet is a single layer while the fold out edge portion is made of multiple layers to give it additional strength. This allows the mylar to be folded so that it lays flat against the main body portion 14. The mylar can be applied to the index sheet stock as each is fed from a separate roll. This assembly can then be punched and die cut to a desired size.

Figure 6:
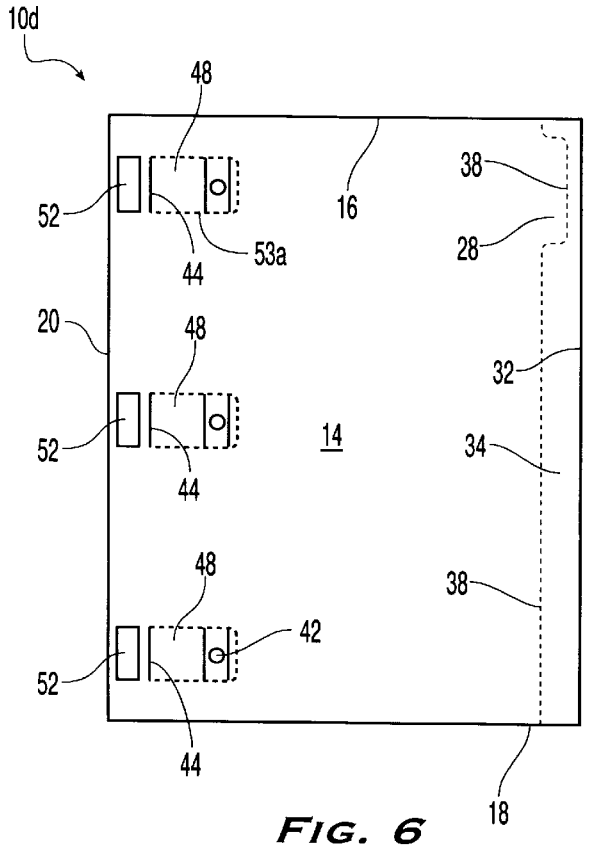
FIG. 6 is a diagrammatic top plan view of a fourth embodiment of an index sheet of the present invention.
Figure 7:
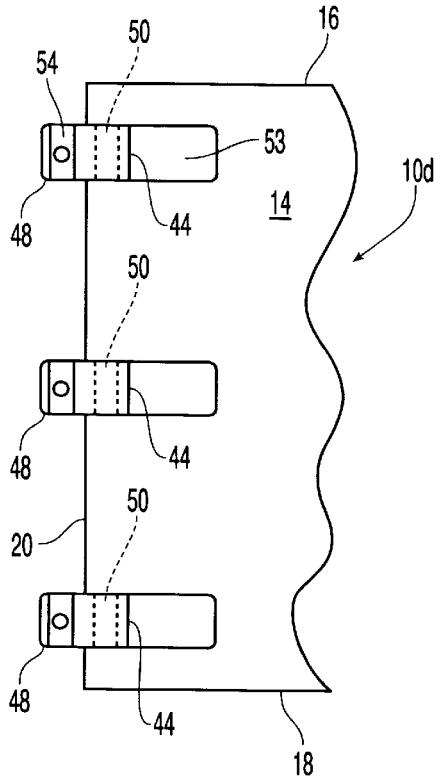
FIG. 7 is a partial view similar to FIG. 6 but after the index sheet has been transformed.

In the embodiment of the index sheet shown in FIGS. 6–7, a part of the main body portion 14 adjacent or near the first lateral side includes a plurality of integrally formed and separate bindable portions 48. Each bindable portion is foldable between i) an unfolded position at which the bindable portion lies and is secured within the first lateral edge and ii) a folded position at which the bindable portion extends beyond the first lateral edge. Preferably, the main body portion 14 adjacent to or near the first lateral edge includes a plurality of optional separate adhesive surfaces 50. Each adhesive surface is arranged to contact a respective bindable portion when the bindable portion is at its folded position. Each adhesive surface is preferably covered by a separate removable strip 52 when the respective bindable portion is at its unfolded position. Each bindable portion is defined by a partial borderline 53 which preferably includes micro perforations 53*a* defined in the main body portion 14 adjacent to or near the first lateral side 20. Each bindable portion defines a bindable hole 42 which may be optionally reinforced by a separate covering 54 formed of a reinforcing material selected from mylar or the like.

Figure 8:
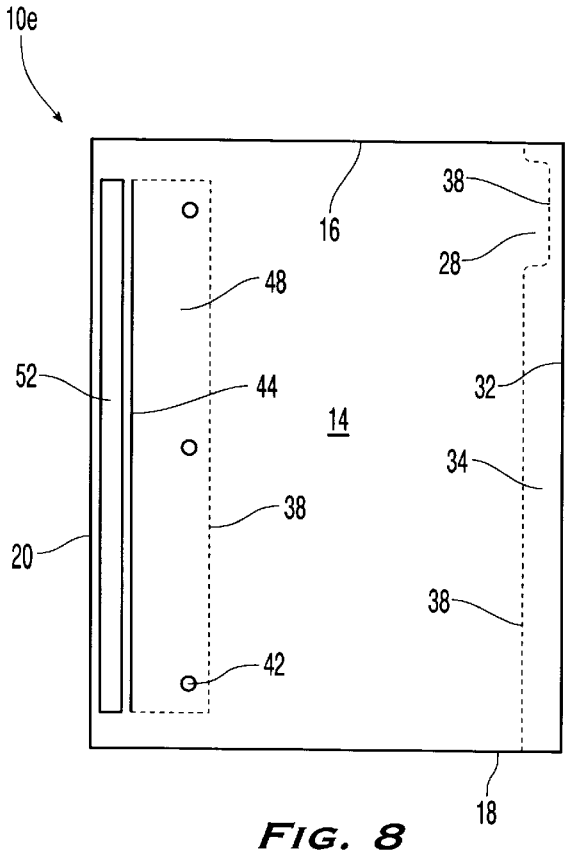
FIG. 8 is a diagrammatic top plan view of a fifth embodiment of an index sheet of the present invention.
Figure 9:
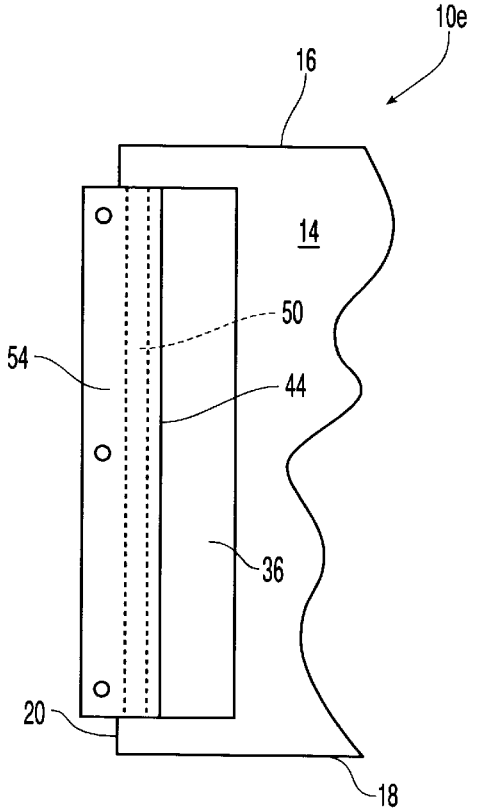
FIG. 9 is a partial view similar to FIG. 8 but after the index sheet has been transformed.

In the embodiment of the index sheet shown in FIGS. 8–9, part of the main body portion 14 adjacent to or near the first lateral side 20 includes a unitary or monolithic bindable portion 48. The bindable portion 48 is foldable between i) an unfolded position at which the bindable portion lies within the first lateral edge 20 and ii) a folded position at which the bindable portion extends outwardly beyond the first lateral side. Preferably, the first lateral edge 20 includes a unitary or monolithic adhesive surface 50 arranged to contact the bindable portion when the bindable portion is at its folded position. Preferably, the adhesive surface is covered by a removable unitary strip 52 when the bindable portion is at its unfolded position. The unitary bindable portion is defined by a partial borderline 36 which preferably includes micro perforations 38 defined in the main body portion 14 near or adjacent to the first lateral edge. The unitary bindable portion defines at least one and preferably a plurality of separate bindable holes 42. Each bindable hole may be optionally reinforced by a unitary covering 54 formed of a material selected from mylar or the like.

Figure 14:
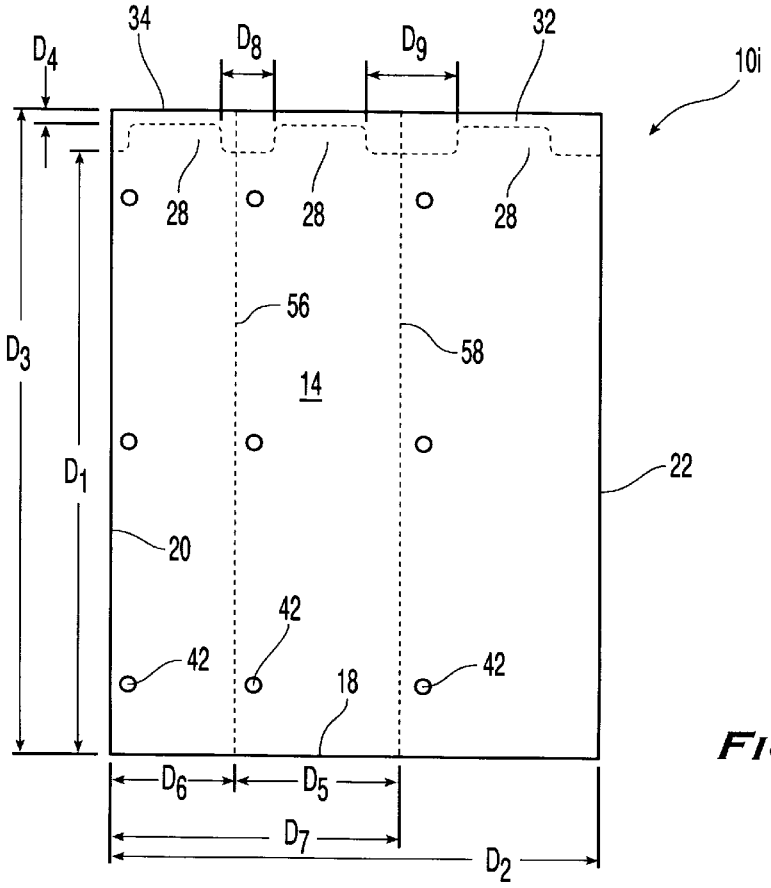
FIG. 14 is a diagrammatic top plan view of a ninth embodiment of an index sheet of the present invention.

In the embodiment of the index sheet shown in FIG. 14, the index tab portions extend from the base which is selected to be the top edge 16. The edge 34 of the guide 32 extends beyond the top edge 16 or base. This index sheet further includes a plurality of separate lines 56,58 of perforations 38 defined in the main body portion 14 and which extend between the top edge 16 to the bottom edge 18. Each successive line of perforations is staggered or spaced from the first lateral edge 20, according to a progressively greater distance than the distance from the line of perforations nearest to the first lateral edge 20. In the embodiment shown in FIG. 14, line 58 is spaced from the next adjacent previous line 56 by a distance $D_5$ which is greater than the spacing $D_6$ of the line 56 from the lateral edge 20. In other words, the line 58 is spaced from the lateral edge 20 by a distance $D_7$ which is progressively greater than twice the distance $D_6$. Preferably, the edge 34 of the guide 32 is straight and is positioned substantially parallel to the bottom edge 18. Each successive index tab portion 28 is staggered or spaced from an adjacent index tab portion according to a progressively greater distance $D_8$, $D_9$.

Figure 15:
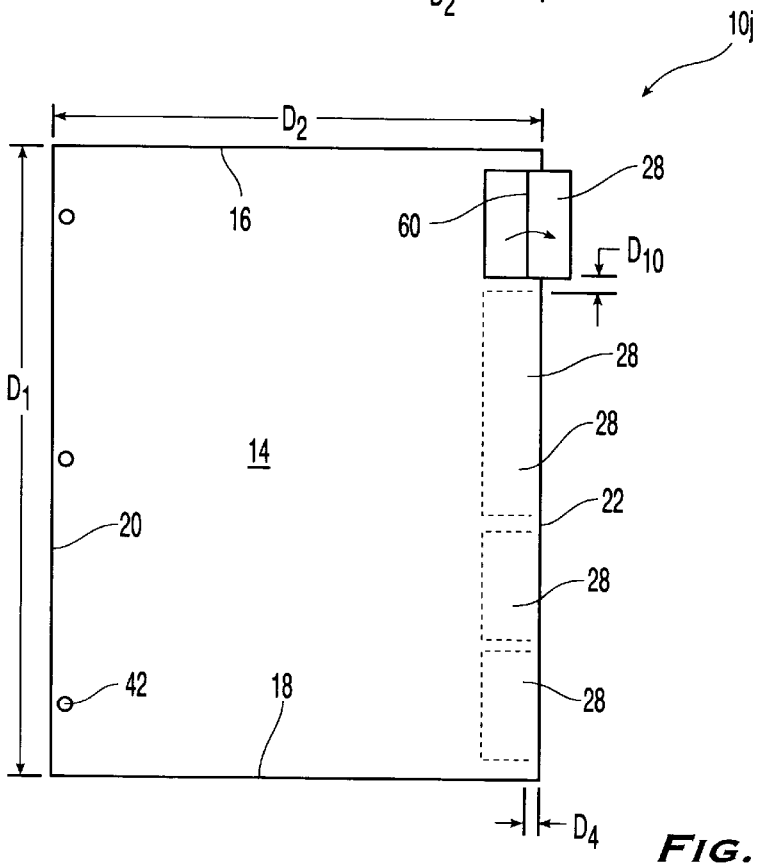
FIG. 15 is a diagrammatic top plan view of a tenth embodiment of an index sheet of the present invention.

In the embodiment of the index sheet shown in FIG. 15, index sheet has at least one and preferably a plurality of index tab portions 28. Each index tab portion is foldable along individual crease line segments 60 between i) an unfolded position at which the index tab portion lies within the second lateral edge and ii) an unfolded position at which the index tab portion extends outwardly beyond the second lateral edge. Alternatively, the crease line segments may be formed after the index tab portion is folded.

Figure 16:
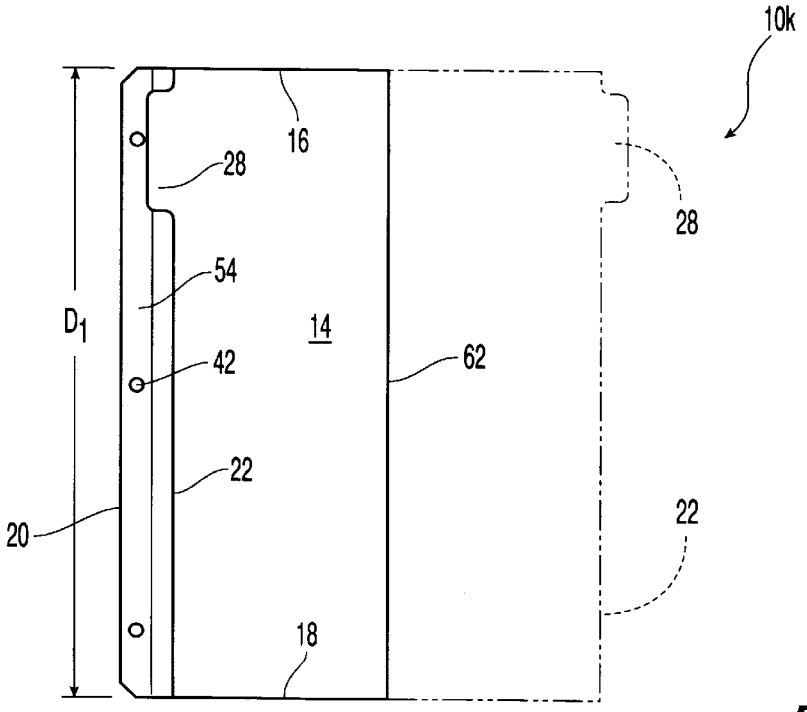
FIG. 16 is a diagrammatic top plan view of an eleventh embodiment of an index sheet of the present invention.

In the embodiment of the index sheet shown in FIG. 16, the index sheet has a central general longitudinally extending crease line 62 defined in the main body portion 14 and which extends between the top and bottom edges 16,18 generally parallel to the lateral edges 20,22. The index tab portion and a part of the main body portion is foldable between i) a folded position at which the index tab portion is positioned between the crease line 62 and the edges opposing the base and ii) an unfolded position at which the index tab portion extends beyond the base.

Figure 17:
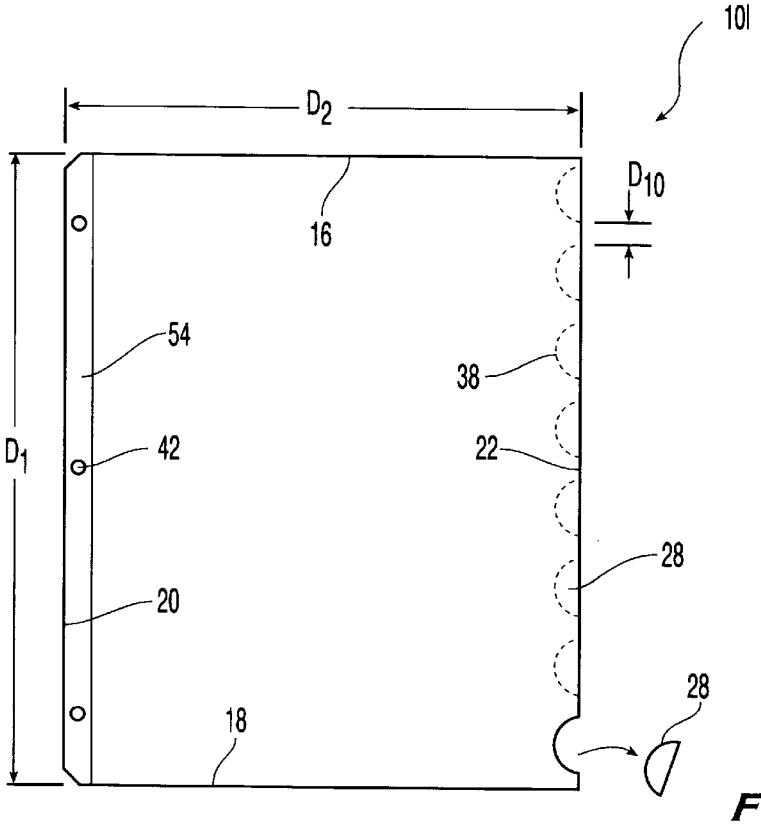
FIG. 17 is a diagrammatic top plan view of a twelfth embodiment of an index sheet of the present invention.

In the embodiment of the index sheet shown in FIG. 17, the index sheet includes at least one and preferably a plurality of mutually spaced and selectively removable index tab portions 28 extending in the main body portion 14 within the base. Adjacent index tab portions are preferably spaced apart according to a uniform distance $D_{10}$.

INDUSTRIAL APPLICABILITY OF THE INVENTION

The index sheets of the present invention enables one to print directly on the index sheet using commonly available laser or inkjet printers.

Figure 2:
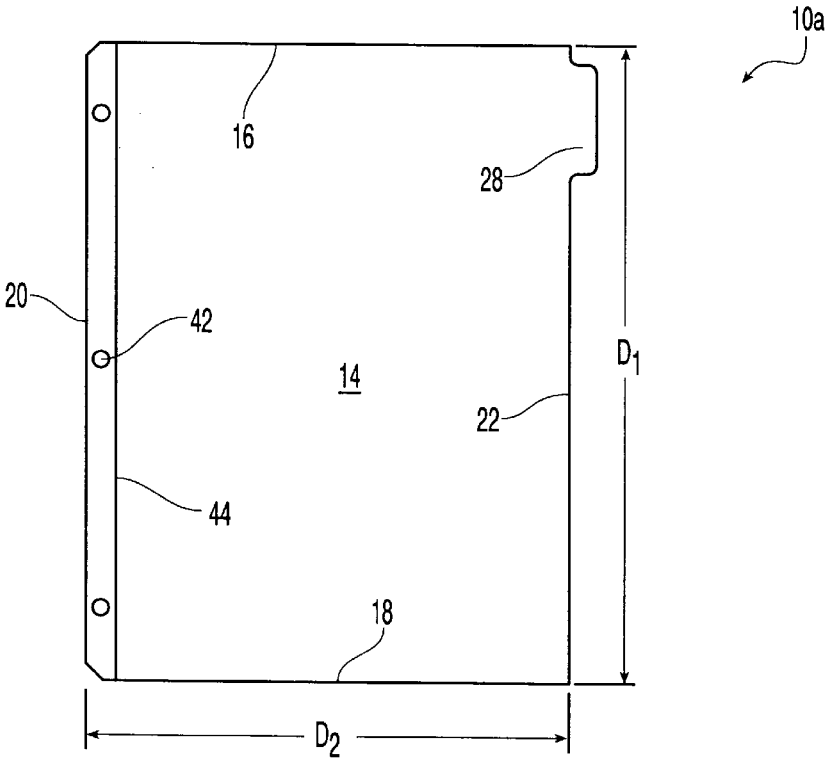
FIG. 2 is view similar to FIG. 1 but after the index sheet has been transformed.
Figure 18:
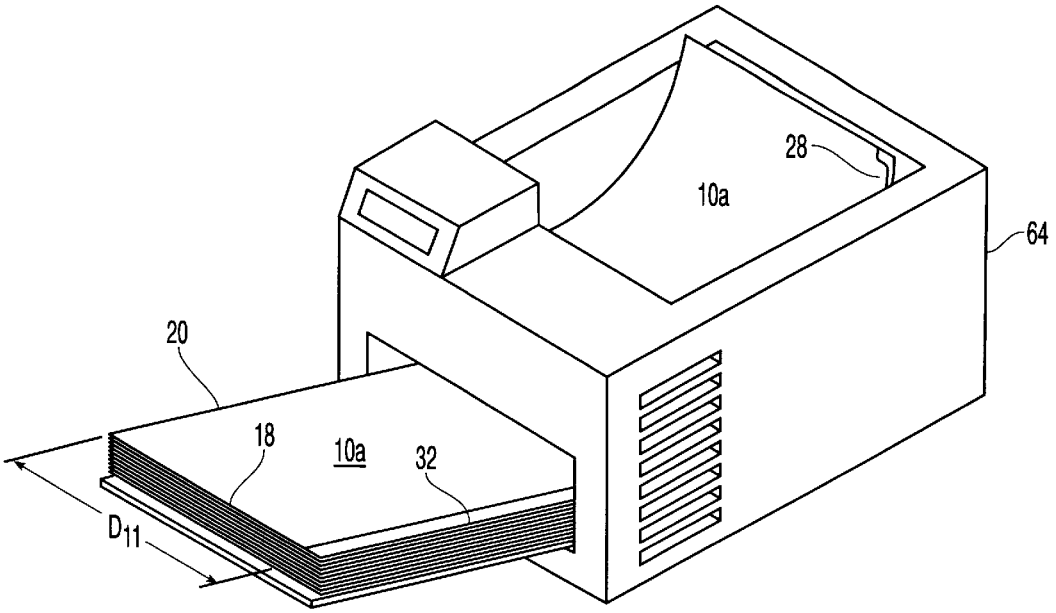
FIG. 18 is a diagrammatic perspective view of a conventional printer supplied with a plurality of index sheets of the present invention according to FIG. 1.
Figure 19:
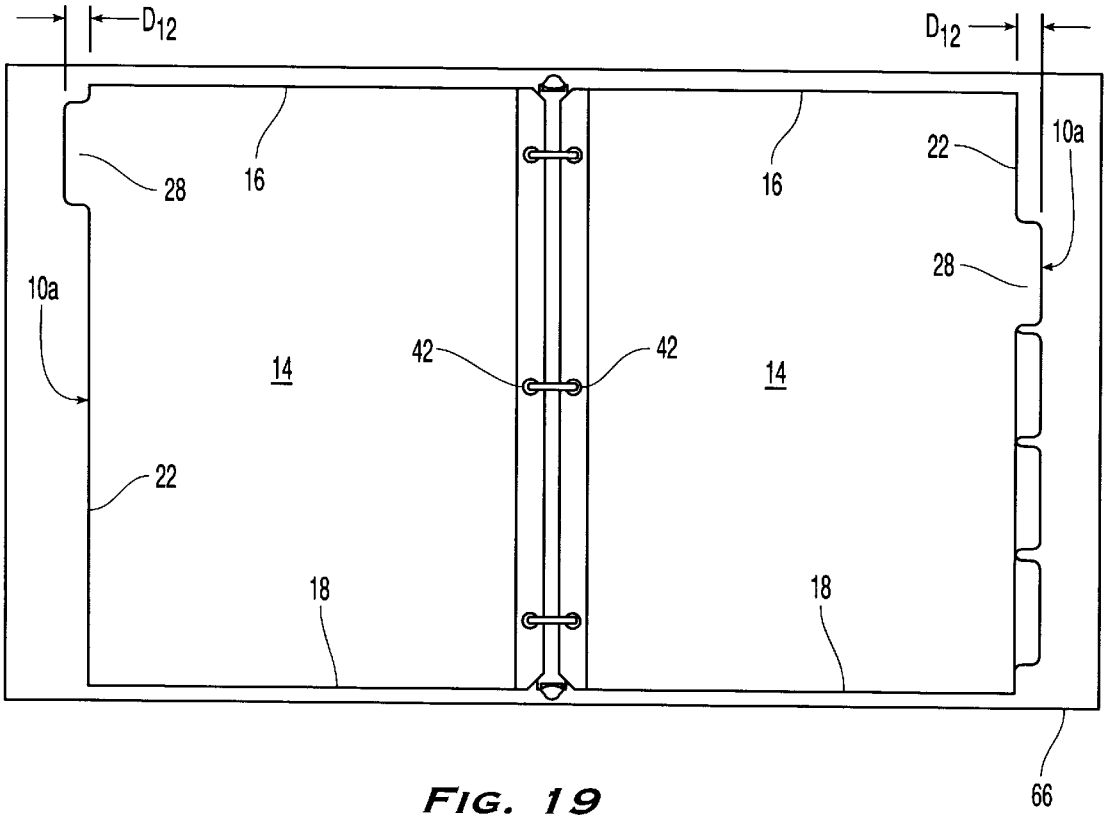
FIG. 19 is diagrammatic perspective view of a conventional looseleaf binder supplied with a plurality of index sheets of the present invention according to FIG. 2 or FIG. 3.

A method of directly printing upon the index sheet with a computer operated printer 64 having a maximum feed distance or width $D_{11}$ will now be described with respect to the embodiment of the index sheet 10a shown in FIGS. 1–2. The method comprises the steps of forming the index sheet according to a first configuration, shown in FIG. 1, in which the index sheet includes a top edge 16 having a uniformly straight leading edge surface to ensure properly controlled feed into the printer. The index sheet also has a uniform width $D_3$ equal to or smaller than the maximum feed width $D_{11}$ of the printer. As shown in FIG. 18, the index sheet is fed to the printer and printed directly upon. The printer preferably uses a software program which is capable of selectively formatting text areas on the index tab portion and/or on the main body portion of the index sheet. Next, the index sheet is transformed according to a second configuration shown in FIG. 2 by completely removing the guide 32 along the borderline of perforations 38. The index sheet is now ready for insertion in a looseleaf binder 66, as shown in FIG. 19, or other binding device so that the index tab portion physically and visually extends beyond the base a selected distance $D_{12}$. Preferably, the dimension $D_2$ is at least as large as the width of text sheets placed between the index sheets.

The present invention is not limited to index sheets or dividers but may also be applied to other bindable items which may have to be printed upon. The index sheets, dividers, or other bindable items may also be accommodated by and printed upon other machines, such as xerographic copiers or photocopiers.

Other aspects, objects, and advantages of this invention can be obtained from a study of the drawings, the disclosure, and the appended claims.

We claim:

1. An index sheet, comprising:

a main body portion having opposed top and bottom edges and opposed first and second edges;

an index tab portion integrally formed with the main body portion and extending outwardly from a base selected from one of said edges;

a guide connected to said base and having a guide edge extending outwardly beyond said base, in the same direction as said index tab portion and at least as far as the index tab portion, said guide being separated from said base by a crease line along which said guide is foldable to reinforce said base; and an adhesive surface on at least one of the guide and the main body portion adjacent to said base, said adhesive surface connecting the guide and the main body portion adjacent to the base when the guide is folded along said crease line.

2. An index sheet comprising:

a main body portion having opposed top edge and bottom edges and opposed first and second lateral edges;

a printable index tab portion integrally formed with the main body portion and extending outwardly from a base selected from one of said edges;

a guide connected to said base and having a guide edge extending outwardly beyond said base, in the same direction as said index tab portion and at least as far as the index tab portion, and wherein said main body portion adjacent the first lateral edge includes at least one integrally formed and separable bindable portion, each bindable portion being foldable between an unfolded position at which the bindable portion lies within the first lateral edge and a folded position at which the bindable portion extends outwardly beyond said first lateral edge.

3. An index sheet comprising:

a main body portion having opposed top edges and bottom edges and opposed first and second lateral edges;

a printable index tab portion integrally formed with the main body portion and extending outwardly from said second lateral edge;

a guide connected to said base and having a guide edge extending outwardly beyond said base, in the same direction as said index tab portion and at least as far as the index ta portion;

at least one integrally formed and separable bindable portion formed in said main body portion at a first location adjacent to and spaced from said first lateral edge, each bindable portion being foldable between an unfolded position, as defined when in said first location, at which the bindable portion lies within the first lateral edge and a folded position at which the bindable portion extends outwardly beyond said first lateral edge;

a separate adhesive surface disposed on said main body portion at a second location spaced between said first lateral edge and said first location and in alignment and contact with said bindable portion when in said folded position.

4. The index sheet of claim 3, wherein the main body portion adjacent said first lateral edge includes a plurality of said bindable portions.

5. The index sheet of claim 4, wherein the main body portion adjacent said first lateral edge includes a plurality of separate adhesive surfaces, each adhesive surface adapted to contact a respective bindable portion when said bindable portion is at its folded position.

6. The index sheet of claim 3 wherein each bindable portion is at least partially surrounded by a plurality of perforations defined in the main body portion adjacent the first lateral edge.

7. The index sheet of claim 3, wherein each bindable portion defines a bindable hole.

8. The index sheet of claim 3, wherein said main body portion adjacent said first lateral edge includes a unitary bindable portion foldable between an unfolded position at which the bindable portion lies within the first lateral edge and a folded position at which the bindable portion extends beyond said first lateral edge.

9. The index sheet of claim 8, wherein the main body portion adjacent said first lateral edge includes a unitary adhesive surface adapted to contact the bindable portion when said bindable portion is at its folded position.

10. The index sheet of claim 9, where said adhesive surface is covered by a removable unitary strip when the bindable portion is at its unfolded position.

11. The index sheet of claim 8, wherein said unitary bindable portion is at least partially surrounded by a plurality of perforations defined in the main body portion adjacent to the first lateral side.

12. The index sheet of claim 9, wherein said unitary bindable portion defines a plurality of separate bindable holes.

13. An index sheet, comprising:

a main body portion having opposed top and bottom edges and opposed first and second edges;

a plurality of laterally spaced index tab portions integrally formed with the main body portion and which extend from said top edge;

a guide having a guide edge which extends beyond said top edge; and a plurality of separate lines of perforations defined in said main body portion and extending between the index tab portions and from the top to the bottom edge, each successive line of perforations being spaced from the next adjacent previous line according to a progressively greater distance than the line of perforations nearest to said first lateral edge is spaced from said first lateral edge.

14. The index sheet of claim 13, wherein said guide edge is positioned substantially parallel to said bottom edge.

* * * * *